US005399802A

United States Patent [19]

Blucher

[11] Patent Number: 5,399,802

[45] Date of Patent: Mar. 21, 1995

[54] ELECTROMAGNETIC PICKUP FOR STRINGED MUSICAL INSTRUMENTS

[75] Inventor: Steven L. Blucher, New York, N.Y.

[73] Assignee: Dimarzio Musical Instrument Pickups, Inc., Staten Island, N.Y.

[21] Appl. No.: 20,866

[22] Filed: Feb. 19, 1993

Related U.S. Application Data

[63] Continuation of Ser. No. 676,788, Mar. 28, 1991.

[51] Int. Cl.[6] ..... G10H 3/18

[52] U.S. Cl. ..... 84/726

[58] Field of Search ..... 84/723, 725, 726, 743

[56] References Cited

U.S. PATENT DOCUMENTS

| | | | |
|---|---|---|---|
| 2,896,491 | 7/1959 | Lover . | |
| 2,911,871 | 11/1959 | Schultz . | |
| 3,588,311 | 6/1971 | Zoller . | |
| 3,916,751 | 11/1975 | Stich | 84/726 |
| 4,283,982 | 8/1981 | Armstrong | 84/725 |
| 4,372,186 | 2/1983 | Aaroe | 84/726 |
| 4,501,185 | 2/1985 | Blucher | 84/723 |
| 4,624,172 | 11/1986 | McDougall | 84/725 |
| 4,809,578 | 3/1989 | Lace, Jr. | 84/726 |
| 4,878,412 | 11/1989 | Resnick | 84/726 |
| 5,111,768 | 5/1992 | Blucher et al. | 84/726 |
| 5,168,117 | 12/1992 | Anderson | 84/726 |

*Primary Examiner*—William M. Shoop, Jr.
*Assistant Examiner*—Jeffrey W. Donels
*Attorney, Agent, or Firm*—Brumbaugh, Graves, Donohue & Raymond

[57] ABSTRACT

An electromagnetic pickup for a stringed musical instrument has an elongated permanent magnet associated with a plurality of pole pieces to establish a magnetic field in which the strings vibrate. The strength of the magnetic field is reduced a desired amount to achieve pleasing tonal quality, by providing a gap in the magnetic circuit between the magnet and the pole pieces. The gap is established by supporting the pole pieces in a retainer bar of non-magnetizable material at predetermined distances from its edge and assembling the elements such that the edge of the retainer bar abuts the adjacent pole face of the magnet. Alternatively, a pole piece with a reduced diameter end may be retained relative to its respective magnet pole face so as to provide an air gap therebetween. Both dual and single bobbin embodiments are described.

8 Claims, 1 Drawing Sheet

ELECTROMAGNETIC PICKUP FOR STRINGED MUSICAL INSTRUMENTS

This application is a continuation of application Ser. No. 07/676,788, filed on Mar. 28, 1991.

This invention relates to electromagnetic pickups for musical instruments and more particularly, to pickups for electrical string instruments which provide a truer, more pleasing tonal quality.

BACKGROUND OF THE INVENTION

Electromagnetic pickups are employed to convert the vibration of the plucked strings in an electric guitar to sound. Such pickups comprise generally a permanent magnet system, including one or more pole pieces, to establish a magnetic field within which the strings vibrate, and a coil structure disposed in the field to generate electrical signals corresponding to the perturbations in the field caused by the vibrating strings. These electrical signals are amplified to drive acoustic loudspeakers to provide the musical sounds.

A variety of electromagnetic pickups have been developed to date. Typically, they include a permanent magnet in magnetic circuit with a number of pole pieces equal to the number of strings on the instrument. The coils for developing the electrical signals are wound on bobbins so arranged that the pole pieces are within the coils to allow the magnetic field developed by the magnet and pole pieces to envelop the coil. Each string, when set into vibration, causes variations in the magnetic field in the vicinity of its associated pole piece or pieces, which variations are converted into electrical signals by the interaction of the magnetic field with the coil.

The basic coil, pole piece and permanent magnet arrangement has taken a number of different physical forms. However, in all configurations known to the inventor, the permanent magnet element has been in direct contact with the pole pieces to assure maximum field strength of the developed magnetic field. One known arrangement, comprising two coils, each with a pair of pole pieces for each of the strings, is illustrated in U.S. Pat. No. 2,896,491, granted Jul. 28, 1959 to Lover. The dual coil arrangement serves to cancel out hum induced by interfering electromagnetic fields and thus improves sound quality. This type of device is commonly referred to as the "humbucker" pickup. An improved form of the two-coil pickup is illustrated and described in copending application Ser. No. 07/578,763, filed Sep. 6, 1990, assigned to the present assignee which issued on May 12, 1992 as U.S. Pat. No. 5,111,728. Other known forms of pickups, such as described in U.S. Pat. No. 2,911,871, granted Nov. 10, 1959, to Schultz, employ a single coil and pole piece array.

These prior art arrangements are characterized in that the permanent magnet element is in direct contact with the pole pieces to provide a strong magnetic field. It is known in the art that variation in tonal quality can be achieved by changing the strength of the magnetic field in which the strings vibrate. As will be understood, the magnetic field tends to dampen the vibrations of a string; the stronger the field, the greater the damping. Differences in the damping factor will affect qualities of the sound generated by the strings, such as the length of the note generated, referred to as the "sustain" and distortion. To the musician, reduction in the damping effect by a limited amount will produce a more pleasing musical sound. However, in the past, this has been accomplished by reducing the field strength of the permanent magnet employed in the pickup in ways that have produced undesirable side effects.

In one such expedient, magnetization of the permanent magnet material is calibrated such that the material is magnetized to less than the maximum possible field strength. Magnets so produced suffer from the tendency to lose magnetic strength relatively quickly, thus affecting sound quality and requiring replacement more frequently. Another expedient is to use an alloy having a weaker field strength, such as Alnico 2 or 3, in place of the stronger field strength and less costly, Alnico 5.

SUMMARY OF THE INVENTION

It is the object of the present invention to provide an electromagnetic pickup for musical instruments in which the magnetic field strength is reduced by a predetermined desired amount to enable the instrument with which it is used to produce more pleasing tonal qualities.

In accordance with the present invention, the controlled reduction in magnetic field strength is achieved by providing a predetermined non-magnetic gap or spacing between the permanent magnet element, preferably made of Alnico 5, and the ferromagnetic pole pieces, thereby reducing field strength. In the embodiments described, the spacing is provided by a non-magnetic element, which may be made of any non-magnetizable material such as aluminum, brass, plastic, etc., inserted between the poles of the magnet and their respective pole pieces, or by an air gap, the reduction in intensity of the magnetic field being dependent upon the magnitude of the spacing. The spacer element is in the form of a bar which retains and supports the pole pieces and, when assembled with the magnet, maintains the pole pieces in the desired spaced relationship to the magnetic poles. The magnet itself is in the form of an elongated bar of rectangular cross section with a pair of opposed longitudinal surfaces magnetized to provide North and South pole faces, respectively, at the longitudinal surfaces. In the two-coil embodiment disclosed, retainer bars on either side of the magnet are mounted in direct contact with the opposed polarized surfaces of the magnet, thereby establishing the desired predetermined spacings between the magnet and each pole piece array.

By appropriate placing of the pole pieces on the retainer bar, the gap between the pole pieces and the magnet may be precisely determined. Different spacings may be selected to provide different tonal qualities.

The invention is also applicable to a single coil pickup, in which case, a pair of elongated permanent magnets are disposed on either side of a non-magnetic retainer bar which supports the pole pieces. The spacing is controlled by the width of the retainer bar relative to the thickness of the pole pieces and the location of the pole pieces on the bar.

BRIEF DESCRIPTION OF THE DRAWINGS

The foregoing objects, features and advantages of the present invention will be understood more fully from the following detailed description thereof when taken in conjunction with the appended drawings in which.

DETAILED DESCRIPTION OF THE INVENTION

Figure 1:
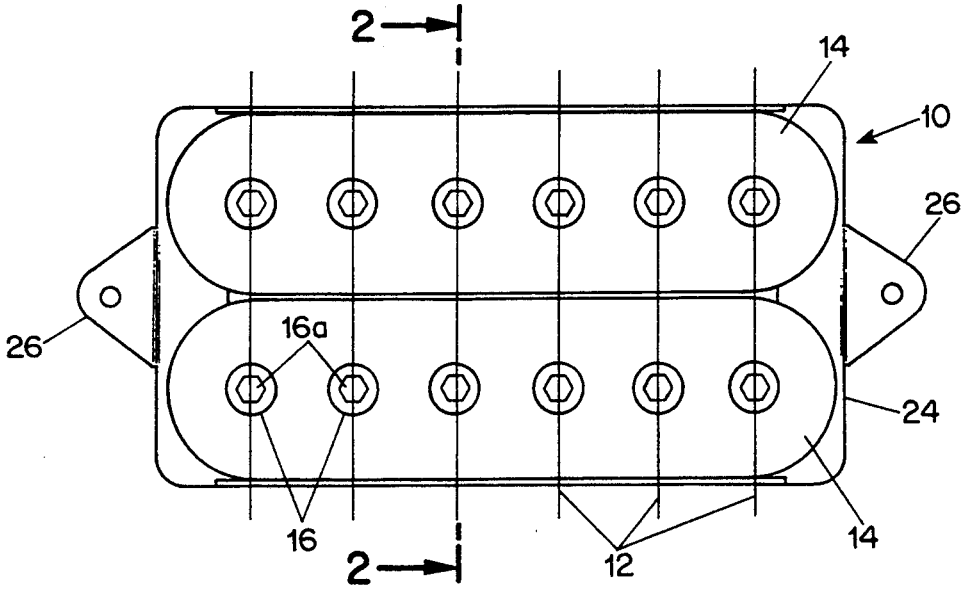
FIG. 1 is a plan view of a pickup in accordance with the invention.
Figure 2:
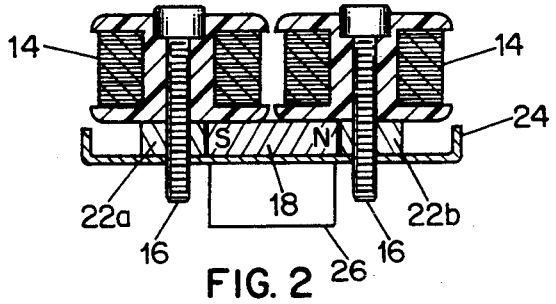
FIG. 2 is a cross section of the pickup of FIG. 1 taken along the lines 2—2.
Figure 3:
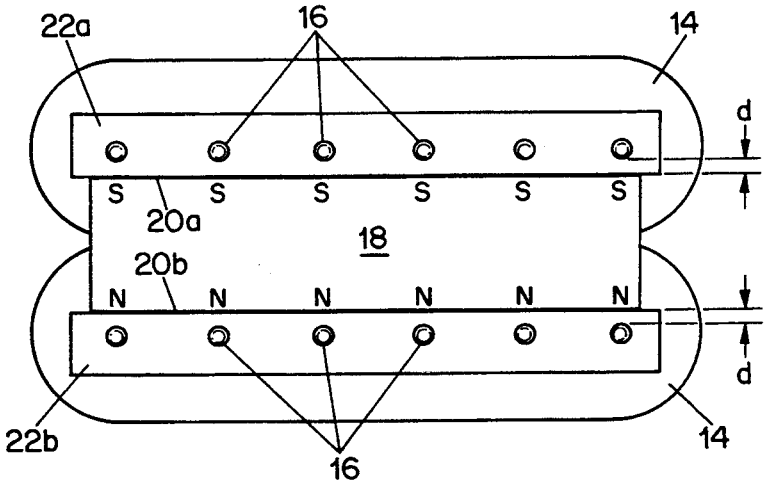
FIG. 3 is a plan view of the pickup of the invention showing the bottom face of the pickup with the mounting plate removed.

Referring now to FIGS. 1, 2 and 3, a pickup 10 in accordance with the invention is illustrated in installed position relative to the strings 12 of a musical instrument such as an electric guitar. Typically six strings are employed on such guitars although the invention is applicable to instruments having more or fewer strings.

The pickup includes a pair of bobbins 14, each comprising a coil of wire wound on an elongated plastic spool, with each bobbin having a pair of leads (not shown) extending therefrom for connection to the amplifier associated with the instrument. Extending through the elongated bobbins are a plurality of pole pieces 16, formed of a ferromagnetic material such as steel, in this case six in each bobbin, which have their upper ends exposed at the upper surface of the bobbin in proximity to the strings 12. As seen best in FIG. 2, each of the pole pieces 16 is in the form of a threaded rod which may be moved vertically to a limited extent to adjust the spacing between the upper end of the pole piece and its associated string.

It will be understood that the pole pieces may take various forms other than the threaded rods of the illustrated embodiment. For example, they may be unthreaded (non-adjustable) cylindrical pins extending through the bobbin or, if a separate pole piece for each string is not desired, a single elongated bar extending through the bobbin over substantially its entire length may be employed. Moreover, various types of pole pieces may be mixed in a single pickup assembly, if desired.

The magnetic field for the pickup is supplied by the elongated magnet 18 (FIG. 3) which is in the form of a bar having a rectangular cross-section with narrow opposed surfaces 20*a* and 20*b*. As indicated in FIGS. 2 and 3, the magnet 18 is magnetized such that one of its longitudinal surfaces, 20*a*, is the South pole face and the other surface, 20*b*, is the North pole face of the magnet. Magnet 18, together with associated pole pieces 16, establish a magnetic field enveloping the strings 12, in a manner known in the art.

As seen best in FIG. 2, the pole pieces 16 are threadedly engaged in retainer bars 22*a* and 22*b*, which are of rectangular cross section, with a longitudinal edge of retainer bar 22*a* abutting surface 20*a* of magnet 18 and a longitudinal edge of retainer bar 22*b* abutting the opposite surface 20*b* of the magnet 18. The retainer bars are made of a non-magnetizable material, such as aluminum, brass or plastic and, with the pole pieces 16 disposed inwardly of the edges abutting the magnet, introduce a gap in the magnetic path between the magnet 18 and the pole pieces 16. The effect of this gap is to reduce the strength of the magnetic field developed by the magnetic circuit to which the strings 12 of the instrument are exposed. The magnitude of the spacing d (FIG. 3) is determined by the location of the threaded holes in the retainer bars 22*a*, b and it is necessary only to substitute retainer bars with different hole spacings and magnets of different widths to achieve different values of field intensity.

When assembled, the retainer bars 22*a, b*, tightly abut the opposed edges of the magnet 18 and the assembly is held in such relationship by a mounting plate 24 made of a non-magnetic material such as brass. Mounting plate 24 includes mounting feet 26 for attachment to the surface of the musical instrument.

Spacing between the tops of the pole pieces 16 and their respective strings 12 may be adjusted, to control amplitude, by further insertion or withdrawal of the threaded pole pieces relative to the retainer bars. For this purpose, shaped recesses 16*a* may be provided in the heads of the pole pieces for engagement by an Allen wrench or equivalent driver. Alternatively, the recesses may be slotted to accommodate a standard or Philips screwdriver.

Figure 4:
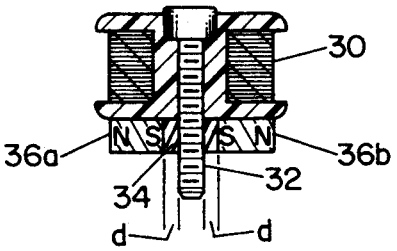
FIG. 4 is a cross-sectional view illustrating the single coil embodiment of the invention.

A single bobbin application of the invention is illustrated in FIG. 4. As in the dual bobbin version described above, the bobbin 30 has a pole piece 32 in the form of a threaded rod extending through the coil into a non-magnetic retainer bar 34. In this embodiment, a pair of permanent magnets 36*a* and 36*b* are provided, each in the form of an elongated bar of rectangular cross section with opposed longitudinal surfaces oppositely magnetized. To develop the appropriate magnetic field, the South pole faces of the respective magnets 36*a*, 36*b*, are disposed in abutting relationship to the opposite longitudinal edges of the retainer bar 34, the width of the bar and the spacing of the holes receiving the pole pieces 32 from the edges of the retainer bar 34 establishing the desired gaps d in the magnetic circuit. The illustrated components are held in assembled relationship by an appropriate mounting plate (not shown). The pole piece 32 may be vertically adjustable as described in connection with the embodiment of FIGS. 1–3.

Figure 5:
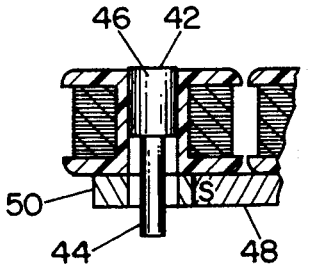
FIG. 5 is a partial cross-sectional view illustrating an alternate form of pole piece in accordance with the invention.

The non-magnetic spacing according to the invention may also be achieved in the manner illustrated in FIG. 5. The cylindrical pole piece 42 extending through the bobbin has its lower end 44 of smaller diameter than its upper end 46, thereby creating a non-magnetic gap between the lower end 44 and the magnet 48 consisting at least in part of an air gap. A non-magnetic retainer bar 50 may be used to hold the magnet 48, if desired, but may be dispensed with altogether. Simply by varying the diameter of the lower ends 44 of some or all of the pole pieces, variations in the width of the gap may be attained.

As can be seen, the invention enables a predetermined change in magnetic field strength to be achieved by introduction of a small non-magnetic space between the magnet pole and its associated pole piece in an electrical musical instrument pickup. The spacing may be controlled, to produce desired musical qualities, without having to vary the magnetic properties or material of the permanent magnet element. In the illustrated embodiments, simply by properly dimensioning the width of the retainer bar and location of the holes for receiving the pole pieces in the retainer bar relative to the width of the magnet or by reducing the diameter of the lower ends of the pole pieces adjacent the magnet, the spacing between the magnet pole and the pole pieces may be predetermined. Not only does this arrangement produce the desired magnetic field control, it does so while maintaining structural integrity of the pickup assembly.

Various modifications of the disclosed embodiments will occur to those skilled in the art. For example, in the dual coil embodiment of FIGS. 1–3, the pole pieces 16 associated with one of the coils 14 may be mounted in direct contact with the magnet, or supported in a retainer of soft iron or other ferromagnetic material, so that no gap is introduced in the magnetic circuit associated with that coil. The imbalance in magnetic field strengths thus induced introduces additional tonal variations in the instrument sound.

Further, the non-magnetic means providing the spacings between the pole pieces and the permanent magnet may be constituted entirely or in part by air gaps, with the pole pieces and permanent magnet supported in the desired relationship on the mounting plate, without changing the principle of operation or function of the device.

These and other modifications of the invention will occur to those skilled in the art and it is intended that the scope of the invention be limited only as set forth in the appended claims.

I claim:

1. An electromagnetic pickup for a stringed musical instrument comprising an elongated coil assembly;

an elongated permanent magnet element extending along one side of said coil assembly, a pole piece of ferromagnetic material extending through said coil assembly and having one end disposed adjacent a string of said instrument and the other end extending towards a pole face of said magnetic element, and non-magnetic means adjacent said other end of said pole piece separating said pole piece from said pole face of said magnet element by a predetermined distance and introducing a gap in the magnetic path between the magnet and said pole piece, said distance being selected to establish a magnetic field of desired intensity in the vicinity of said string.

2. An electromagnetic pickup as in claim 1 wherein said permanent magnet element is an elongated bar of permanent magnet material having a rectangular cross-section, opposed longitudinal surfaces of said bar constituting said north and south pole faces, respectively.

3. An electromagnetic pickup as in claim 2 wherein there are provided a plurality of pole pieces extending through said coil assembly, one for each string of said instrument, one end of each of said pole pieces being disposed adjacent a respective string of said instrument and the other ends of said pole pieces extending towards one of said opposed longitudinal surfaces of said permanent magnet element and separated therefrom by said non-magnetic means.

4. An electromagnetic pickup as in claim 3 further comprising an additional elongated coil assembly, an additional plurality of pole pieces, one for each string of said instrument, extending through said additional coil assembly, one end of each of said additional plurality of pole pieces being disposed adjacent a respective string of said instrument and the other ends of said additional plurality of pole pieces extending towards the other of said opposed longitudinal surfaces of said permanent magnet element, and additional non-magnetic means adjacent said other ends of said additional pole pieces separating said additional pole pieces from said other opposed longitudinal surface of said permanent magnet element by a predetermined distance.

5. An electromagnetic pickup as in claim 3 wherein said non-magnetic means comprises an elongated bar of non-magnetizable material having an longitudinal edge abutting said one opposed longitudinal surface of said permanent magnet element and said other ends of said pole pieces being secured to said non-magnetic bar at respective locations separated from said surface of said permanent magnet element by said predetermined distance.

6. An electromagnetic pickup as in claim 4 wherein each of said non-magnetic means comprises an elongated bar of non-magnetizable material, one longitudinal edge of each of said non-magnetic bars abutting respective opposed longitudinal surfaces of said permanent magnet element, and said other ends of said pluralities of pole pieces being secured to their associated non-magnetic bars at locations separated from the respective opposed surfaces of said permanent magnet element by said predetermined distance.

7. An electromagnetic pickup for a multi-stringed musical instrument comprising an elongated permanent magnet element of rectangular cross-section with opposed relatively narrow longitudinal surfaces constituting north and south pole faces, respectively, a plurality of pole pieces each having one end disposed adjacent its respective string and the other end extending towards one of said narrow longitudinal surfaces of said permanent magnet element, coil means associated with said pole pieces for generating electric currents varying in accordance with vibrations of said strings, and non-magnetic means adjacent said other ends of said pole pieces separating said pole pieces from said permanent magnet elements by predetermined distances and introducing a gap in the magnetic paths between said magnet element and said pole pieces, said predetermined distances being selected to establish magnetic fields of desired intensity in the vicinity of said strings.

8. An electromagnetic pickup as in claim 7 wherein said non-magnetic means comprises an elongated bar of non-magnetizable material and said other ends of said pole pieces are retained in said non-magnetic bar to maintain constant said predetermined distances.

* * * * *